US006400386B1

(12) United States Patent
No

(10) Patent No.: US 6,400,386 B1
(45) Date of Patent: Jun. 4, 2002

(54) METHOD OF PRINTING A FLUORESCENT IMAGE SUPERIMPOSED ON A COLOR IMAGE

(75) Inventor: Young No, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/547,603

(22) Filed: Apr. 12, 2000

(51) Int. Cl.[7] ..... B41J 2/325
(52) U.S. Cl. ..... 347/176; 347/43
(58) Field of Search ..... 347/212, 172, 347/174, 176, 43; 400/120.02, 120.04; 358/532; 382/266

(56) References Cited

U.S. PATENT DOCUMENTS

| | | | |
|---|---|---|---|
| 2,302,645 | A | 11/1942 | Switzer et al. |
| 4,038,123 | A | 7/1977 | Sammis |
| 4,122,237 | A | 10/1978 | Kaiserman |
| 4,652,464 | A | 3/1987 | Ludlum et al. |
| 4,866,025 | A | 9/1989 | Byers et al. |
| 4,871,714 | A | 10/1989 | Byers et al. |
| 4,876,237 | A | 10/1989 | Byers et al. |
| 4,891,351 | A | 1/1990 | Byers et al. |
| 4,891,352 | A | 1/1990 | Byers |
| 5,006,503 | A | 4/1991 | Byers et al. |
| 5,011,816 | A | 4/1991 | Byers et al. |
| 5,057,852 | A | 10/1991 | Formica et al. |
| 5,084,309 | A | 1/1992 | Smith et al. |
| 5,421,869 | A | 6/1995 | Gundjian et al. |
| 5,516,362 | A | 5/1996 | Gundjian et al. |

*Primary Examiner*—Huan Tran
(74) *Attorney, Agent, or Firm*—Norman Rushefsky

(57) ABSTRACT

A method of printing a fluorescent image superimposed on a color image. An image source captures an image and converts the image to an image file that is transferred to a controller. The controller controls operation of a print head that prints a plurality of monochrome images forming a color image when the monochrome images are superimposed in registration one upon the other. In the case of a thermal dye printer, the plurality of monochrome images are formed by selective thermal transfer of dye from yellow, magenta and cyan dye color patches to a receiver. In the case of an inkjet printer, the plurality of monochrome images are formed by selective activation of ink channels containing cyan, magenta and yellow ink so as to eject cyan, magenta and yellow ink droplets onto the receiver. In the case of the thermal dye printer, the invention provides a dye carrier containing a phosphorous dye color patch. In the case of an inkjet printer, the invention provides that at least one of the channels contains a phosphorous colorant. After the color image is formed, using either the thermal dye printer or the ink jet printer, image information defined only by a selected one of the monochrome images is used by the print head to print a fluorescent image superimposed on the color image. The fluorescent image is printed bi-modally in registration with the selected one of the monochrome images. In this manner, the fluorescent image defines an outline of the color image, so that the color image is recognizable in a dark viewing area.

12 Claims, 6 Drawing Sheets

METHOD OF PRINTING A FLUORESCENT IMAGE SUPERIMPOSED ON A COLOR IMAGE

FIELD OF THE INVENTION

This invention is generally related to color printing, and more particularly, to a method of printing a fluorescent image superimposed on a color image such that only an outline of the color image fluoresces to enhance visibility of the image when the image is viewed in a dark viewing area.

BACKGROUND OF THE INVENTION

Printers, such as thermal dye color printers and ink jet color printers, print color images supplied by an image source, such as a camera. The image source in turn transmits the image as an image file to a controller that controls operation of a print head. The print head then operates to print the image on a receiver according to the image file transmitted to the controller.

More specifically, thermal dye color printers thermally activate a dye carrier having a repeating series of spaced frames of different colored heat transferable dyes. In such printers, the carrier is disposed between the receiver, such as coated paper, and a plurality of individual heating elements of a printhead. When a particular heating element is energized, dye transfers from the carrier to the receiver. The density of the printed colored dye image is a function of the energy delivered by the heating element to the carrier. Thermal dye transfer printers offer the advantage of true "continuous tone" dye density transfer by varying the energy applied to each heating element, thereby yielding variable dye density image pixels on the receiver.

The dye frames of the carrier are typically yellow, magenta and cyan dye frames. First, as the yellow dye frame and the receiver are simultaneously advanced and positioned under the print head, the heating elements are selectively energized corresponding to the blue information of the input image data in order to form a row of yellow image pixels in the receiver. This process is repeated until a yellow dye image is formed in the receiver. The receiver is then retracted the same distance as it was advanced. Next, the magenta dye frame and the receiver are simultaneously advanced and positioned under the print head and the heating elements are again selectively energized corresponding to the green information of the input image data in order to form a magenta image superimposed upon the yellow image. The receiver is again retracted the same distance as it was advanced. Finally, the cyan dye frame and the receiver are simultaneously advanced and positioned under the print head and the heating elements are selectively energized corresponding to the red information of the input image data to form a cyan dye image superimposed upon the yellow and magenta dye images. The yellow, magenta and cyan dye images combine to form a color image. In some printers, a lamination dye layer (i.e., a transparent dye layer) is transferred to the receiver over the color image to protect the image from damage. This protective dye layer preferably has a uniform thickness and is transferred to the receiver by energizing all the heating elements with a uniform energy level.

In another method of thermal printing, one or all of the colored dye frames may contain phosphorous pigments. The image printed with such a dye frame is indistinguishable with an image printed with ordinary dye when viewed under a broad spectrum light, but with fluorescence the image becomes visible in a dark viewing area. In this manner, the printer produces a "glow in the dark" print.

However, thermal dye printers that use phosphorous pigments mixed with the color dyes to produce the glow in the dark print have several drawbacks. For example, since typical image data of a color plane contains varying density of information, from minimum density to maximum density, and is typically dispersed throughout the color plane, the resulting print fluoresces substantially uniformly. Hence, when such a print is viewed in a dark area, the whole printed area glows, making the image virtually unrecognizable.

In the case of an ink jet printer, digital signals as to each of four colors (i.e., red, green, blue and black) regarding an image are processed in a manner so that a multi-nozzle print head belonging to the ink jet printer forms a printed color image on the receiver. More specifically, when the sidewalls of corresponding ink channels formed in the print head inwardly move due to actuation of the sidewalls, a pressure wave is established in the ink contained in the channel. This pressure wave squeezes a portion of the ink in the form of an ink droplet out the ink channel. This ink droplet lands on the receiver to form a pixel. A multiplicity of such pixels form the image.

However, as in the case of thermal dye printing, one or all of the colored inks may contain phosphorous pigments. The image printed with such an ink is indistinguishable with an image printed with ordinary ink when viewed under a broad spectrum light, but with fluorescence the image becomes visible in a dark viewing area. In this manner, ink jet printers can also produce a "glow in the dark" prints.

However, ink jet printers that use phosphorous pigments mixed with color ink have several drawbacks. For example, since typical image data of a color plane contains a varying density of information, from minimum density to maximum density, and is typically dispersed throughout the color plane, the resulting print fluoresces substantially uniformly. Hence, when such a print is viewed in a dark area, the whole printed area glows, making the image virtually unrecognizable.

Therefore, there is a need to provide a method of printing a fluorescent image superimposed on a color image such that the image is recognizable when the image is viewed in a dark viewing area.

SUMMARY OF THE INVENTION

The present invention provides a "glow in the dark" image by utilizing an additional phosphorous color plane to transfer phosphorous pigments. First, the yellow dye frame and the receiver are moved to be positioned under the print head and as they are advanced, the heating elements are selectively energized corresponding to the blue information of the input image data to form a row of yellow image pixels in the receiver. This process is repeated until a yellow dye image is formed in the receiver. The receiver is then retracted the same distance as it was advanced. Next the magenta dye frame is moved under the print head and the receiver is also moved under the print head. Both the receiver and the magenta dye frame are advanced as the heating elements are selectively energized corresponding to the green information of the input image data and a magenta image is formed superimposed upon the yellow image. The receiver is again retracted the same distance as it was advanced. The cyan dye frame and the receiver are moved under the print head. Both the receiver and the cyan dye frame are advanced as the heating elements are selectively energized corresponding to the red information of the input image data and a cyan dye image is formed on the receiver superimposed upon the yellow and magenta dye images. A phosphorus color plane is then transferred to the receiver. The phosphorous color plane is preferably derived from the green color plane and contains only bi-modal edge information of the image in the green color plane. All other information of the green color plane is discarded.

Thus, phosphorous pigments are transferred and superimposed to the color image only to outline the original image with the edge information. The resulting print produces a well-defined glow in the dark image when the print is viewed in a dark area because only the outline of the image fluoresces.

It is an object of the present invention to provide a method of printing a fluorescent image that when viewed in a dark area produces a sharp image.

It is another object of the present invention to provide a method of printing an image which in ambient light shows a non-fluorescent image and in a dark area shows a sharp fluorescent image.

It is a further object of the present invention to provide a method which produces a sharp fluorescent image using standard, commercially available, thermal dye printers or ink jet printers.

A feature of the present invention is the provision of a dye donor ribbon having a phosphorous color patch that is used to produce a phosphorescent image preferably derived from the green color plane of a color image, the phosphorescent image containing only bi-modal edge information of the green color plane.

An advantage of the present invention is that use thereof provides a glow in the dark print having an image that is recognizable when viewed in a dark area.

Other objects, features and advantages of the present invention will be apparent from the following detailed description in which the preferred embodiments have been set forth in conjunction with the accompanying drawings.

BRIEF DESCRIPTION OF THE DRAWINGS

In describing the preferred embodiments of the invention, reference is made to the following figures briefly described hereinbelow.

Figure 1:
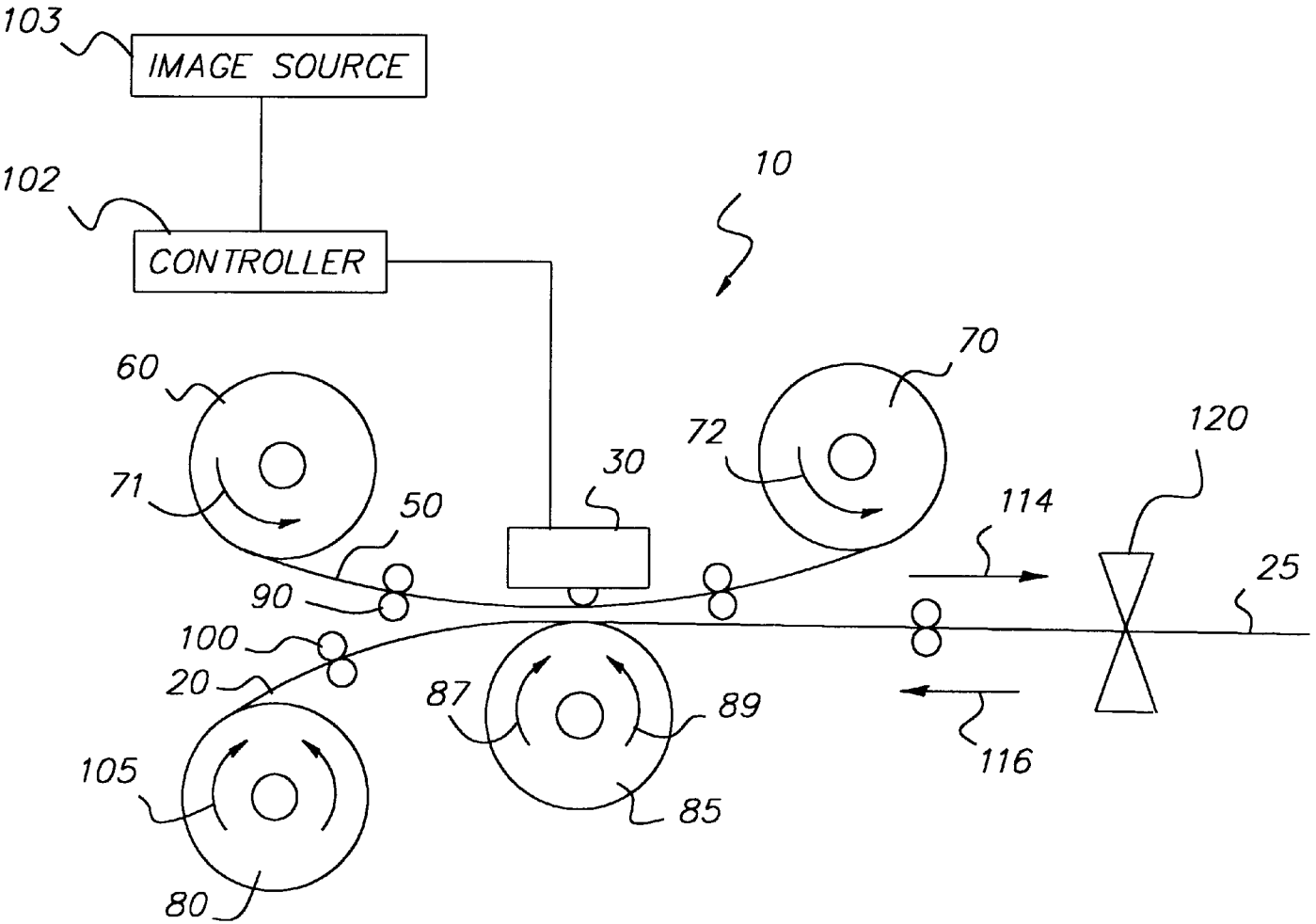
FIG. 1 a view in elevation of a first embodiment printer, which is a thermal dye printer, the printer having a print head.

There may be additional structures described which are not depicted in the figures. In the event such a structure is described but not depicted by a figure, the absence of such a figure should not be considered as an omission of such structure from the specification.

DETAILED DESCRIPTION OF THE INVENTION

The invention is described in detail with particular reference to certain preferred embodiments thereof, but it will be understood that variations and modifications can be effected within the spirit and scope of the invention.

Therefore, referring to FIGS. 1, 2 and 3, there is shown a first embodiment printer, which is a thermal dye color printer, generally referred to as 10, adapted to provide a sharp glowing image on a receiver media 20 when a finished print 25 made from receiver media 20 is viewed in a dark area, as disclosed in more detail hereinbelow. Receiver medium 20 may be paper or transparency.

Referring again to FIGS. 1, 2 and 3, printer 10 comprises a print head 30 having a plurality of resistive heater elements 40 (only one of which is shown). Heater elements 40 heat when electrical current is applied thereto from a power source (not shown). A dye donor ribbon 50 is suspended between a donor ribbon supply spool 60 and a donor ribbon take-up spool 70, in a manner such that donor ribbon 50 extends across heater elements 40. Supply spool 60 and take-up spool 70 may have suitable motors (not shown) engageable therewith for synchronously rotating supply spool 60 and take-up spool 70 in the directions shown by arrows 71 and 72, respectively. Donor ribbon 20 itself comprises a plurality of color dye patches for obtaining color images to be deposited on receiver medium 20. In the preferred embodiment of the invention, there are three color patches as follows: color patch 75*a* for yellow (Y); color patch 75*b* for magenta (M); color patch 75*c* for cyan (C); color patch 75*d* for phosphorous (P); and color patch 75*e* for transparent laminate (L). The fluorescent material comprising phosphorous patch 75*d* in donor ribbon 20 is preferably dispersed in a polymeric binder such as a cellulose derivative, e.g., cellulose acetate hydrogen phtha-late, cellulose acetate, cellulose acetate propionate, cellulose acetate butyrate, cellulose triacetate; a polycarbonate; poly(styrene-co-acrylonitrile), a poly(sulfone) or apoly(phenylene oxide). The binder may be used at a coverage of from about 0.1 to about 5 g/m2.

Figure 2:
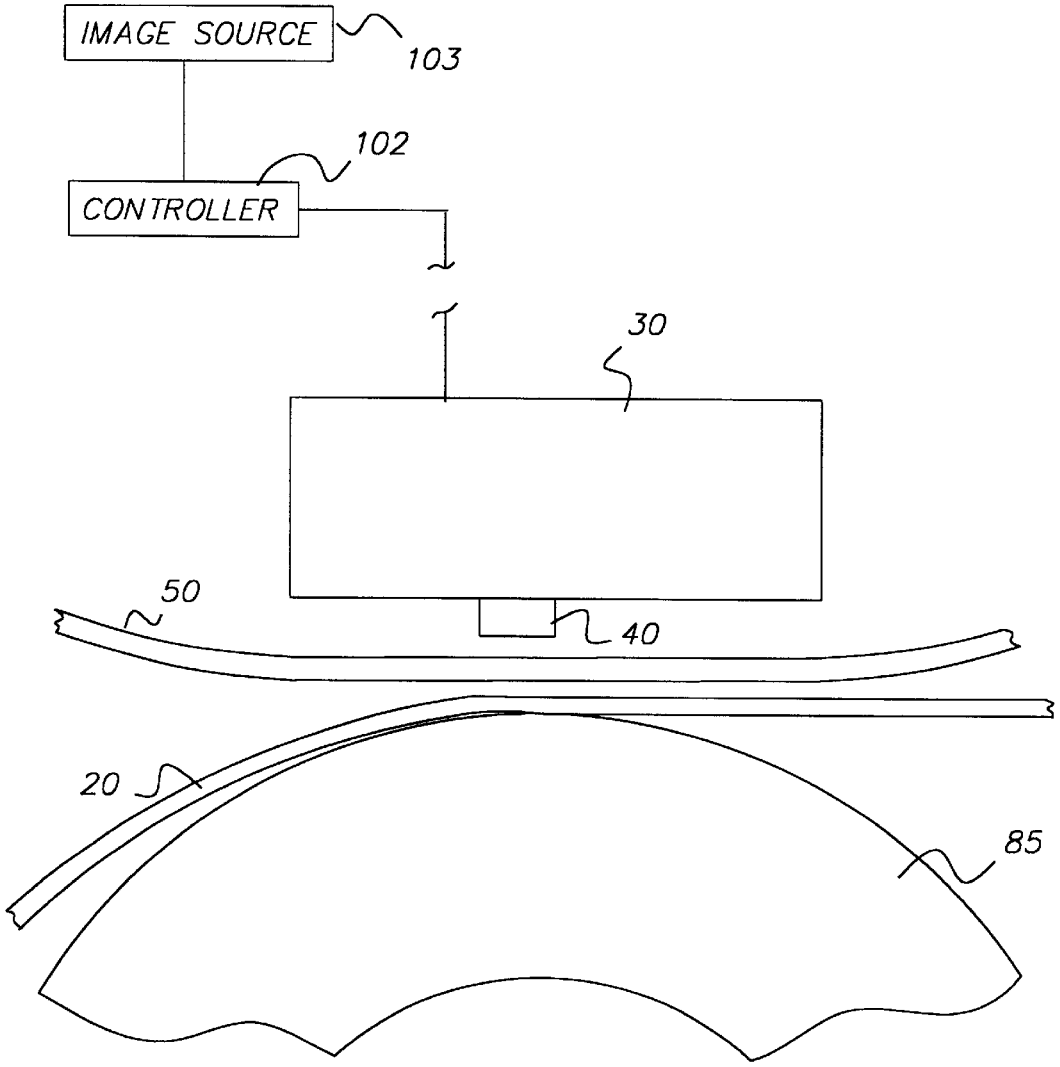
FIG. 2 is a view in elevation of the print head.
Figure 3:
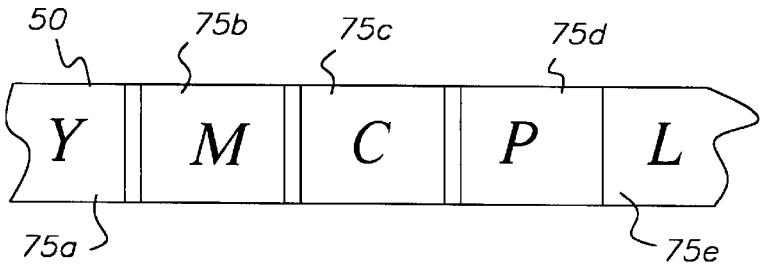
FIG. 3 shows a thermal dye ribbon usable with the print head.
Figure 4:
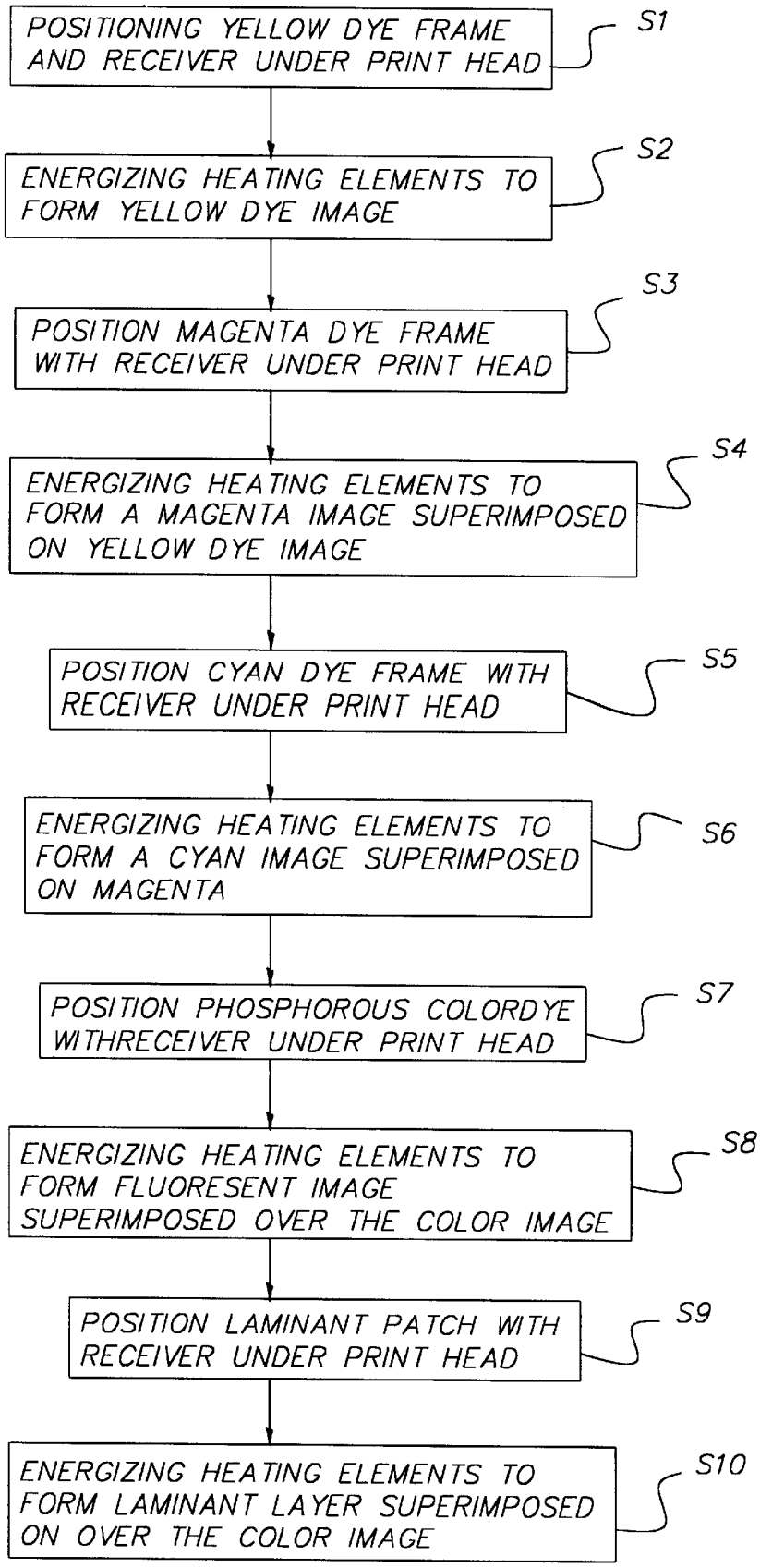
FIG. 4 displays a flow chart showing steps in the method of the present invention.

Still referring to FIGS. 1, 2 and 3, a receiver supply 80, in the form of a receiver roll, supplies receiver 20 to print head 30. Although receiver supply 80 is disclosed herein as being a roll of receiver, receiver supply 80 may alternatively be a supply tray (not shown) containing cut sheets of receiver. Print head 30 is caused to bring heater elements 40 and donor ribbon 50 into contact with receiver 20, whereupon heater elements 40 are activated to transfer dye from a selected one of patches 75*a*/75*b*/75*c*/75*d*/75*e* onto receiver 20. A motorized platen roller 85 capable of rotating in a clockwise direction 87 and a counter-clockwise direction 89 is also provided for reasons disclosed hereinbelow. A purpose of platen roller 85 is to provide support to receiver medium 20 as print head 30 and donor ribbon 50 press against receiver medium 20 to deposit an image thereon. In addition, a plurality of freely-rotatable donor ribbon guide rollers 90 are also provided for guiding donor ribbon 50 into alignment with heater elements 40. Moreover, a plurality of freely-rotatable receiver guide rollers 100 may be provided for guiding receiver 20 to platen roller 85. Alternatively, receiver guide rollers 100 may be motor-driven in synchronization with rotation of platen roller 85, if desired, for feeding receiver medium 20 to printhead 30. In any case, synchronous operation of print head 20, heater elements 40, supply spool 60, take-up spool 70, and platen roller 85 to produce print 25 are controlled by a controller 102 interconnecting printhead 30 and an image source 103. Image source 130 supplies an input image file to controller 102. Image source 130 may be any commercially available image source, such as a digital camera, and controller 102 may be a "Model CompuMotor"™ controller available from Parker Hannifin Company, located in Rohnert Park, Calif.

Referring to FIGS. 1, 2, 3 and 4, a fluorescent image is produced first by positioning yellow dye patch 75*a* and a portion of receiver medium 20 between heater elements 40 and platen roller 85, as indicated by Step S1. Positioning of yellow dye patch 75*a* is achieved by synchronous rotation of donor ribbon supply spool 60 and donor ribbon take-up spool 70. Positioning of receiver medium 20 is achieved by rotation of platen roller 85 in the clockwise direction, as illustrated by an arrow 87, in order to advance receiver medium 50 in a forward feed direction indicated by arrow 114. In this regard, operation of platen roller 85 is synchronized with operation of supply roller 60 and take-up roller 70.

Again referring to FIGS. 1, 2, 3 and 4, as yellow patch 75*a* and receiver 20 are advanced in direction of arrow 114, heating elements 40 are selectively energized in a manner corresponding to the blue information of input image data in order to form an image row of yellow image pixels on receiver 20, as indicated by Step S2. This process of forming yellow image rows is repeated until a complete yellow dye image is formed on receiver 20. Platen roller 85 is then rotated in counter-clockwise direction 89 to retract receiver 20 in direction of an arrow 116 the same distance as receiver 20 was advanced. Magenta dye patch 75*b* is moved under print head 30, as indicated by Step S3.

As magenta patch 75*b* and receiver 20 are advanced in direction of arrow 114, heating elements 40 are again selectively energized in a manner corresponding to the green information of input image data in order to form an image row of magenta image pixels on receiver 20, as indicated by Step S4. This process of forming magenta image rows is repeated until a complete magenta dye image is formed on receiver 20. In this manner, the magenta image is formed superimposed in registration upon the yellow image. Platen roller 85 is then rotated in counter-clockwise direction 89 to retract receiver 20 in direction of arrow 116 the same distance as receiver 20 was advanced. Cyan dye patch 75*c* is then moved under print head 30, as indicated by Step S5.

As cyan patch 75*c* and receiver 20 are advanced in direction of arrow 114, heating elements 40 are again selectively energized in a manner corresponding to the green information of input image data in order to form an image row of magenta image pixels on receiver 20, as indicated by Step S6. This process of forming cyan image rows is repeated until a complete cyan dye image is formed on receiver 20. In this manner, the cyan image is formed superimposed in registration upon the yellow and magenta image images. Platen roller 85 is then rotated in counter-clockwise direction 89 to retract receiver 20 in direction of arrow 116 the same distance as receiver 20 was advanced. At this point, each color plane contains a monochrome image and the combination of color planes provides the desired color image. Phosphorous dye patch 75*d* is then moved under print head 30, as indicated by Step S7.

As phosphorous patch 75*d* and receiver 20 are advanced in direction of arrow 114, heating elements 40 are again selectively energized in a predetermined manner. In order to form an image row of phosphorescent image pixels on receiver 20, as indicated by Step S8. This process of forming phosphorescent image rows is repeated until a predetermined phosphorescent dye image is formed on receiver 20. As disclosed more filly hereinbelow, the phosphorescent image is superimposed upon a predetermined portion of the yellow, magenta and cyan image. Platen roller 85 is then rotated in counter-clockwise direction 89 to retract receiver 20 in direction of arrow 116 the same distance as receiver 20 was advanced. Laminate dye patch 75*e* is then moved under print head 30, as indicated by Step S9.

As laminate dye patch 75*e* and receiver 20 are advanced in direction of arrow 114, heating elements 40 are again selectively energized in a predetermined manner, in order to form an image row of laminate pixels on receiver 20, as indicated by Step S10. This process of forming laminate rows is repeated until a laminate layer is formed covering the image on receiver 20. Preferably, this printed protective dye layer has a uniform thickness and is transferred to receiver 20 by energizing all heating elements 40 with a uniform energy level. In this manner, the laminate is formed superimposed upon the yellow, magenta, cyan, and phosphorous image. Platen roller 85 then continues to rotate in clockwise direction 87 to advance receiver 20 in direction of arrow 114 to the location of a cutter 120 where the now completed print is cut to size.

Previously mentioned phosphorous dye patch 75*d* is used to transfer phosphorous pigments that have been preferably mixed with a color dye. In this regard, the phosphorous pigments can be mixed with any color dye and printed using the phosphorous color plane information. However, mixing the phosphorous pigments with yellow color dye is preferred because the human eye is less sensitive to the yellow image layer of a print. This will minimize apparent print color hue changes of the print.

Alternatively, however, dispersing the phosphorous pigments in transparent laminate dye patch 75*e* may be used. When such a print is viewed in a dark area since, only the transparent dye layer will fluoresce, thereby producing a sharp glowing image.

The phosphorous color plane is preferably derived from the green color plane and contains only bi-modal edge information of the image. The terminology "bi-modal edge information" refers to high-contrast edge information. That is, "bi-modal" information is information that is characterized by the qualities of extreme lightness and darkness, such as is found at the edges of a dark object against a light background, or a light object against a dark background. Since the green color plane typically contains the most light and dark information of the image and hence, the most edge information, the green color plane is preferred to extract the edge information. All other information of the green color plane is discarded.

Edge information of the image is extracted from the green color plane after transferring all the normal color planes (i.e., yellow, magenta, and cyan). Phosphorous pigments are transferred and superimposed to the color image only to outline the original image with the edge information. The resulting print produces a very sharp glow image when the print is viewed in a dark area, since only the outline of the image fluoresces.

Although glow in the dark images can be produced by thermal dye printers, glow in the dark images can also be produced by ink jet printers using the method of the invention.

Figure 5:
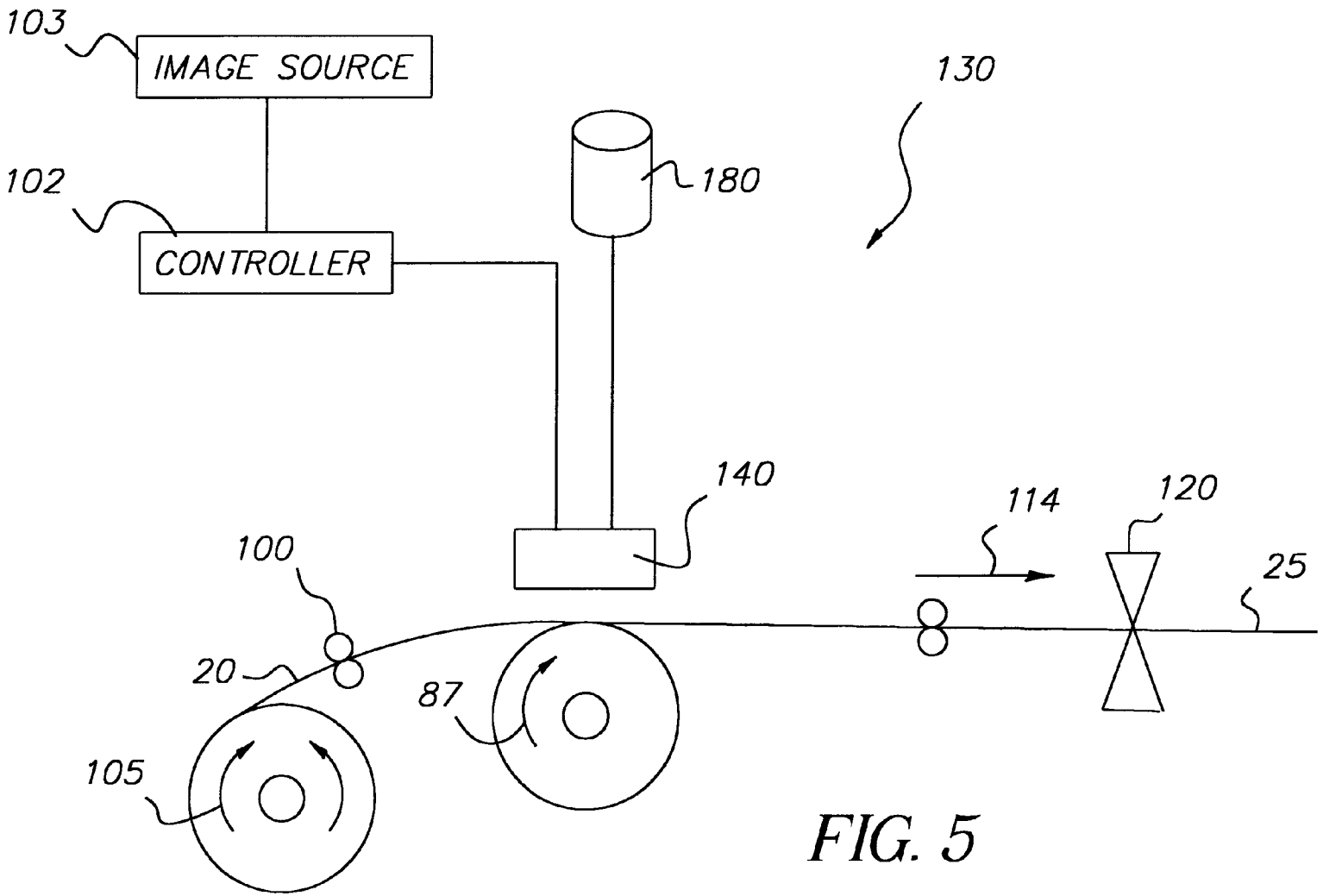
FIG. 5 is a view in elevation of a second embodiment printer, which is an ink jet printer, the printer having an ink jet print head.
Figure 6:
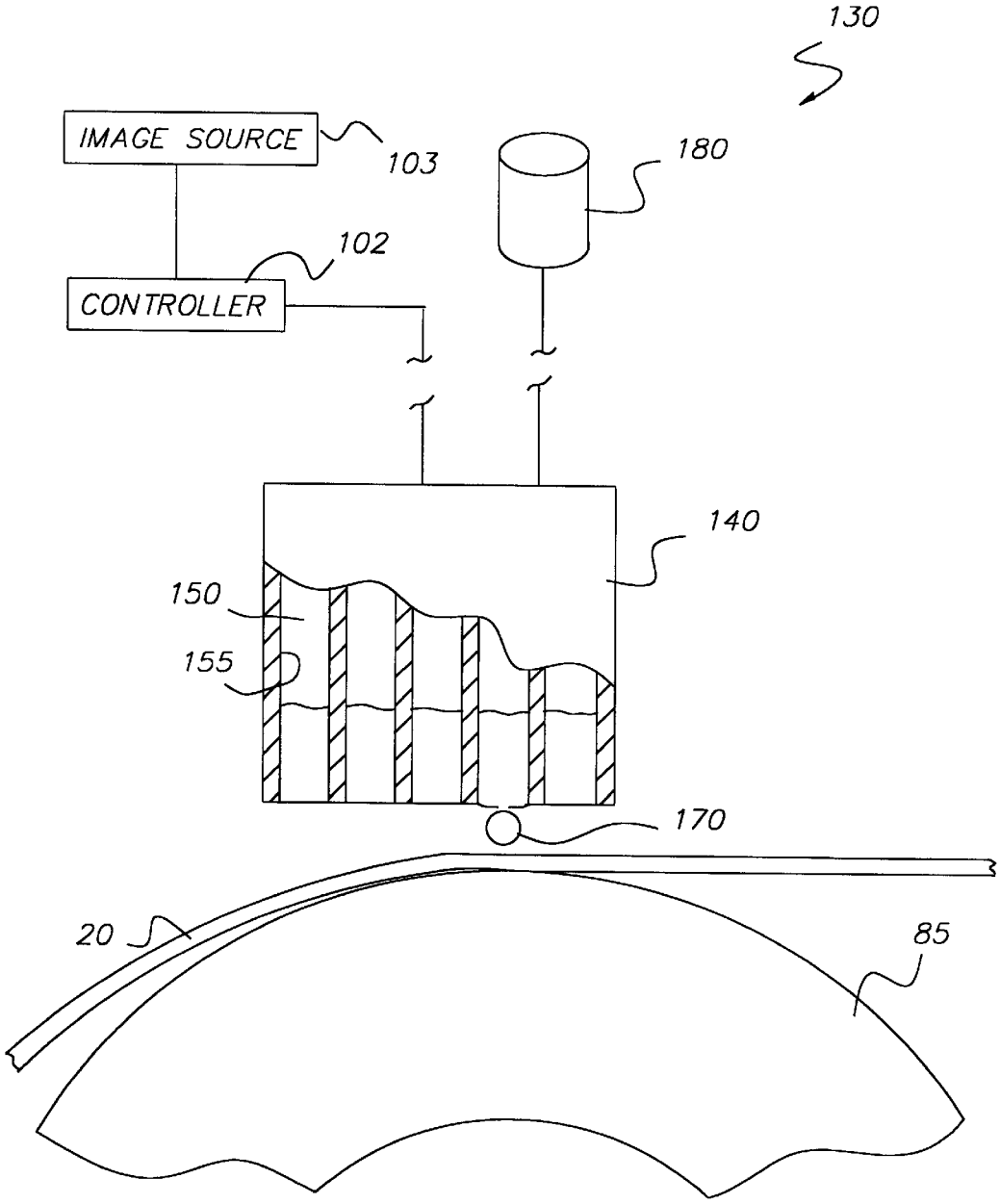
FIG. 6 is a view in partial elevation of the ink jet print head.

Therefore, referring to FIGS. 5 and 6, there is shown a second embodiment printer, which is an ink jet printer, generally referred to as 130, adapted to provide a sharp glowing image on receiver media 20 when finished print 25 made from receiver media 20 is viewed in a dark area, as disclosed in more detail hereinbelow. Printer 130 comprises an ink jet printhead 140 having a plurality of ink channels 150 therein for holding ink 155, which may be cyan, magenta, yellow or black ink. Each channel 150 is capable of ejecting a plurality of ink droplets 170 (only one of which is shown) under control of controller 102. It may be appreciated that when yellow ink is ejected, a blue color plane of the output image is formed. Similarly, when magenta or cyan is ejected, a green or red color plane, respectively, of the output image is formed. As is well known in the art, equal amounts of cyan, magenta and yellow ink will form a black color on the paper, however, in many high quality ink jet systems black ink is also selectively applied to help increase black density and minimize the total volume of ink that needs to be applied to the paper. Moreover, the colored ink is supplied to printhead 140 by means of ink reservoirs 180 (only one of which is shown) connected to printhead 140. Each reservoir 140 contains a respective one of the ink colors cyan, magenta, yellow or black. In this manner, each color plane contains a monochrome image. In addition, preferably one of reservoirs 180 contains fluorescent ink to be deposited on receiver 20 to form a phosphorous color plane, which is preferably derived from the green color plane. The phosphorous color plane contains only bi-modal edge information of the image. All other information of the green color plane is discarded. The resulting print produces a sharp glow in the dark image when the print is viewed in a dark area because only the outline of the image fluoresces.

Figure 7A:
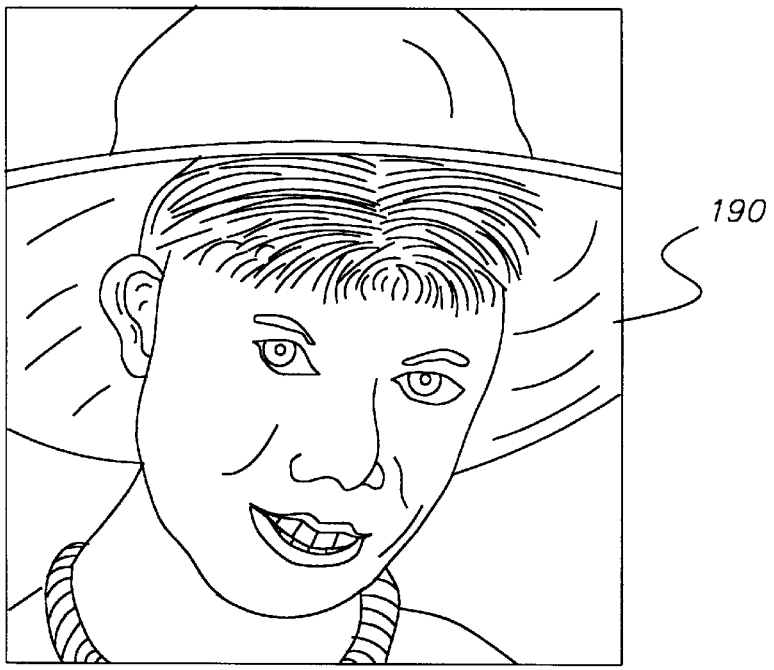
FIG. 7A is a representation of a green color plane belonging to a color image.

FIG. 7A represents a magenta dye image 190 corresponding to the green color plane of an input color image for the case of a thermal dye printer. FIG. 7A may also be viewed as representing the magenta color ink jet image corresponding to the green color plane of an input color image for the case of an ink jet printer.

Figure 7B:
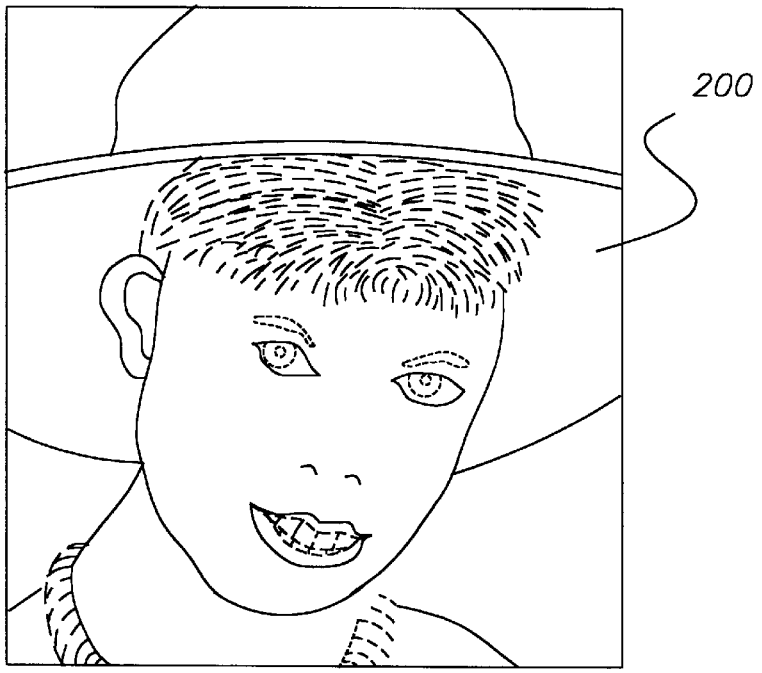
FIG. 7B is a representation of fluorescent edge information extracted from the green color plane of the input color image.

FIG. 7B represents a fluorescent dye image 200 corresponding to edge information extracted from the green color plane of the input color image for the case of a thermal dye printer. FIG. 7B may also be viewed as representing the fluorescent dye image 200 corresponding to edge information extracted from the green color plane of the input color image for the case of an ink jet printer.

Further modification and variation can be made to the disclosed embodiments without departing from the subject and spirit of the invention as defined in the claims hereinbelow. Such modifications and variations, as included within the scope of these claims, are meant to be considered part of the invention as described. For example, the method of the invention is disclosed for use with a thermal color printer or ink jet color printer. However, it should be appreciated that the method of the invention may also be used with a laser thermal printer or any printer capable of depositing colorant on a receiver.

Therefore, what is provided is a method of printing a fluorescent image superimposed on a color image such that the image is recognizable when the image is viewed in a dark viewing area.

PARTS LIST

10. thermal dye color printer
20. receiver medium
30. printhead
40. heater elements
50. dye donor ribbon
60. donor ribbon supply spool
70. donor ribbon take-up spool
71. direction of rotation for donor ribbon supply spool
72. direction of rotation for donor ribbon take-up spool
75*a*. yellow dye patch
75*b*. magenta dye patch
75*c*. cyan dye patch
75*d*. laminate
80. receiver supply spool
85. platen roller
87. direction of rotation of platen roller for advancing receiver medium in forward feed direction
89. direction of rotation of platen roller for retraction of receiver in reverse feed direction
90. donor guide rollers
100. receiver guide rollers
102. controller
103. image source
105. direction of rotation of receiver supply spool for advancing receiver in forward feed direction
114. forward feed direction
116. reverse feed direction
120. cutter
130. ink jet color printer
140. ink jet print head
150. ink channels
155. ink
170. ink droplets
180. ink reservoir
190. image corresponding to a green color plane of an input color image
200. fluorescent dye image corresponding to edge information extracted from the green color plane of the input color image

What is claimed is:

1. A method of printing a fluorescent image superimposed on a color image, comprising the steps of:

(a) printing a plurality of monochrome images forming a color image when superimposed one upon the other;

(b) selecting one of the monochrome images; and (c) printing a fluorescent image superimposed on the selected one of the monochrome images, so that the fluorescent image defines an outline of the color image.

2. The method of claim 1, wherein the step of printing a fluorescent image comprises the step of bi-modal printing of the fluorescent image.

3. The method of claim 1, wherein the step of printing a fluorescent image comprises the step of printing the fluorescent image with a fluorescent colorant viewable only in a dark area.

4. The method of claim 1, wherein the step of printing a plurality of monochrome images comprises the step of printing the plurality of monochrome images by thermally activating respective ones of a plurality of dye monochrome color patches.

5. The method of claim 1, wherein the step of printing a plurality of monochrome images comprises the step of printing the plurality of monochrome images by ejecting respective ones of a plurality of monochrome ink droplets.

6. The method of claim 1, further comprising the step of applying a laminate layer to the fluorescent image.

7. A method of printing a fluorescent image superimposed on a color image such that only an outline of the color image fluoresces to enhance visibility of the color image when the color image is viewed in a dark viewing area, comprising the steps of:

(a) selecting a dye carrier carrying a plurality of dye color patches thereon, the dye color patches being a yellow dye color patch, a magenta dye color patch, a cyan dye color patch and a phosphorous dye color patch;

(b) selectively energizing a plurality of heating elements to sequentially transfer a dye from each of the yellow, magenta and cyan dye color patches to a receiver, whereby the yellow, magenta and cyan dye color patches respectively form a plurality of monochrome images that when superimposed in registration one on the other define a color image on the receiver after dyes therefrom sequentially transfer to the receiver; and (c) selectively energizing the plurality of heating elements to transfer a phosphorous dye from the phosphorous dye color patch to the receiver according to a selected one of the monochrome images, whereby the phosphorous dye color patch defines an outline of the color image on the receiver as phosphorous dye therefrom transfers to the receiver in registration with the selected one of the monochrome images and whereby an outline of the color image fluoresces when the color image is viewed in a dark area.

8. The method of claim 1, wherein the step of selectively energizing the plurality of heating elements to transfer a phosphorous dye from the phosphorous dye color patch comprises the step of bi-modally energizing of the plurality of heating elements to transfer the phosphorous dye from the phosphorous dye color patch.

9. The method as recited in claim 7, wherein the step of selectively energizing the plurality of heating elements to transfer a phosphorous dye from the phosphorous color patch comprises the step of selectively energizing the plurality of heating elements to transfer the phosphorous dye mixed with a laminate material to define a phosphorous-laminate dye layer.

10. A method of printing a fluorescent image superimposed on a color image such that only an outline of the color image fluoresces to enhance visibility of the color image when the color image is viewed in a dark viewing area, comprising the steps of:

(a) providing an inkjet printer having a plurality of channels respectively containing a cyan ink, a magenta ink, a yellow ink, an optional black ink and a phosphorous colorant;

(b) selectively activating the plurality of the channels to sequentially transfer the cyan, magenta and yellow inks to a receiver, whereby the cyan, magenta and yellow inks respectively form a plurality of monochrome images that when superimposed in registration one on the other define a color image on the receiver after the cyan, magenta and yellow inks sequentially transfer to the receiver; and (c) selectively activating the plurality of channels to transfer a phosphorous colorant to the receiver according to a selected one of the monochrome images, whereby the phosphorous colorant defines an outline of the color image on the receiver as the phosphorous colorant transfers to the receiver in registration with the selected one of the monochrome images and whereby an outline of the color image fluoresces when the color image is viewed in a dark area.

11. The method of claim 10, wherein the step of selectively activating the plurality of channels to transfer a phosphorous colorant to the receiver according to a selected one of the monochrome images comprises the step of bi-modal selective activation of the plurality of channels to transfer the phosphorous colorant from the phosphorous colorant channel.

12. The method as recited in claim 10, wherein the step of selectively activating the plurality of channels to transfer a phosphorous colorant comprises the step of selectively activating the plurality of channels to transfer the phosphorous colorant mixed with a laminate material to define a phosphorous-laminate ink layer.

* * * * *